United States Patent [19]

Onishi et al.

[11] 4,010,031

[45] Mar. 1, 1977

[54] ELECTROPHOTOGRAPHIC SYSTEM

[75] Inventors: Masaru Onishi; Koichi Tomura, both of Amagasaki, Japan

[73] Assignee: Mitsubishi Denki Kabushiki Kaisha, Tokyo, Japan

[22] Filed: Jan. 22, 1975

[21] Appl. No.: 542,906

[30] Foreign Application Priority Data

Jan. 23, 1974 Japan ..... 49-10543

[52] U.S. Cl. ..... 96/1 TE; 96/1.4; 355/3 DD

[51] Int. Cl.[2] ..... G03G 0/00

[58] Field of Search ..... 96/1 TE, 1.4, 1.5, 1 E

[56] References Cited

UNITED STATES PATENTS 3,573,906 4/1971 Goffe ..... 96/1

*Primary Examiner*—John D. Welsh

[57] ABSTRACT

A photosensitive plate includes a transparent electrode layer, a transparent carrier blocking layer of polyvinyl carbazole and a P type photoconductive layer superposed on one another and opposed to a dielectric recording medium with a gap therebetween. While a recording voltage is applied across the electrode layer and recording medium with positive polarity being imparted to the electrode layer, an imaging light irradiates the photoconductive layer to transfer a corresponding electrostatic latent image formed on that layer to the recording medium across the gap. For an N type photoconductive layer, a negative polarity is imparted to the electrode layer.

8 Claims, 8 Drawing Figures

ELECTROPHOTOGRAPHIC SYSTEM

BACKGROUND OF THE INVENTION

This invention relates to improvements in an electrophotographic process called commonly a "TESI (transfer-of-electrostatic image) process" and more particularly to improvements in a photosensitive plate used with such an electrophotographic process.

Electrophotographic processes convert a particular optical image to a corresponding electrostatic latent image, transfer the electrostatic latent image to a dielectric recording medium and to develop the transferred electrostatic latent image on the record medium by using, for example, the toner powder. One of such electrophotographic processes, which is called a TESI process is disclosed and claimed in Japanese Pat. No. 238,843. According to the cited patent, a first main surface of a photoconductive layer of a predetermined conductivity is disposed opposite to a dielectric recording medium with a very narrow gap formed therebetween while the second main surface of the photoconductive layer is irradiated with light representative of an object to be recorded (which light may be called hereinaftr the "imaging light") resulting in the completion of the recording process. More specifically, this irradiation of the photoconductive layer with the imaging light causes the generation of hole-electron pairs in the material of the layer. Among the hole-electron pairs thus generated in the photoconductive layer those carriers identical in polarity to the majority carriers present in the photoconductive layer are transferred to the first main surface of the photoconductive layer until they form an electrostatic latent image corresponding to the optical image to be recorded. Then the electrostatic latent image thus formed is transferred to the recording medium formed of a dielectric material through the very narrow gap. This results in the formation of an electrostatic latent image corresponding to the optical image on the recording medium.

In order that among the hole-electron pairs generated in the photoconductive layer those carriers identical in polarity to the majority carriers present within the photoconductive layer are transferred to the first main surface of the layer and also in order to transfer the electrostatic latent image formed on the first main face of the photoconductive layer to the recording medium, it is required to apply across the photoconductive layer and recording medium a recording voltage with a predetermined polarity from a source of recording voltage. To this end, this recording source has a first terminal connected to the record medium through a suitable voltage path and a second terminal connected to a transparent electrode layer disposed upon the second main surface of the photoconductive layer. As the second main surface of the photoconductive layer must be irradiated with an imaging light that electrode layer should be formed of any suitable transparent, electrically conductive material.

In order that, among the hole-electron pairs generated in the photoconductive layer, those carriers identical in polarity to the majority carriers present in that layer are moved to the first main surface of the layer, a certain relationship should be provided between the conductivity of the photoconductive layer and the polarity of the recording source. That is, for P type conductivity photoconductive layers, the recording source should have a polarity such that the second terminal thereof connected to the transparent electrode layer on the second main surface of the photoconductive layer has a positive polarity while the first terminal thereof coupled to the recording medium has a negative polarity. With the recording source having a polarity as above described, holes of the hole-electron pairs generated in the P type photoconductive layer are transferred to the first main surface of the layer. On the other hand, for N type conductivity photoconductive layers, the respective terminals of the recording source should be reversed in polarity from those above described in conjunction with the P type photoconductive layers. In the latter event, electrons of the hole-electron pairs generated in the N type photoconductive layer are transferred to the first main surface of the layer.

If the relationship reversed from that above described is provided, it is difficult to form the required electrostatic latent image. For example, where the photoconductive layer has a P type conductivity, the application of a recording voltage to the transparent electrode layer from the recording source to put the electrode layer at a negative potential will cause electrons of the hole-electron pairs generated in the photoconductive layer to be transferred to the first main surface thereof. During their transfer, the electrons are apt to be recombined with the majority carriers or the holes present within the P type photoconductive layer resulting in their extinction. As a result, it becomes difficult to produce the required electrostatic latent image on the first main surface of the photoconductive layer.

It has been found that the required relationship as above described gives one undesirable result. For example, for the P type conductivity photoconductive layers the transparent electrode layer should be put at a positive potential. This results in the occurrence of the phenomenon that the majority carriers or the holes from the transparent electrode layer are injected into the photoconductive layer regardless of the particular imaging light irradiating the latter layer. This phenomenon can also occur on a dark portion of an optical image formed on the transparent electrode layer. As a result, background noise is produced to decrease the signal-to-noise ratio of the resulting electrostatic latent image or visible image developed on the recording medium leading to a reduction in contrast of the final recorded image. That undesirable phenomenon also occurs in the case of N type photoconductive layers. This is because the transparent electrode layer is put at a negative potential and therefore injects majority carriers or electrons into the photoconductive layer therefrom.

Accordingly, it is an object of the present invention to provide a new and improved TESI electrophotographic process of forming an electrostatic latent image having an improved signal-to-noise ration on the recording medium involved by decreasing the background noise of the electrostatic latent image.

SUMMARY OF THE INVENTION

The present invention resides in an improved photosensitive plate for use in an electrophotographic process said a photosensitive plate including a photoconductive layer of a predetermined conductivity type having a pair of first and second main surfaces opposite to each other and including majority carriers having a predetermined polarity, and a transparent electrode layer disposed on the second main surface of the photoconductive layer, a dielectric recording medium disposed in spaced opposed relationship with the first main surface of the photoconductive layer to leave a gap therebetween, a source of recording voltage for applying a recording voltage across the transparent electrode layer and the dielectric recording medium, and a transparent carrier blocking layer sandwiched between said second main surface of said photoconductive layer and said transparent electrode layer. In using this plate in the process, a recording step is conducted so that the applied recording voltage has a polarity rendering said electrode layer identical in polarity to the majority carriers present in the photoconductive layer while an imaging light to be recorded irradiates the photoconductive layer through the transparent electrode layer and the carrier blocking layer to generate hole-electrons pairs in that portion of the photoconductive layer adjacent to the second main surface thereof and to transfer those carriers of the hole-electron pairs identical in polarity to the majority carriers present in the photoconductive layer to the first main surface to form an electrostatic latent image corresponding to the imaging light on the first main surface of the photoconductive layer, the electrostatic latent image being transferred to the dielectric recording medium, the transparent carrier blocking layer being operative to prevent those carriers identical in polarity to the majority carriers present in the photoconductive layer from being injected into the photoconductive layer from the electrode layer.

The transparent carrier blocking layer is preferably formed of polyvinyl carbazole.

The transparent carrier blocking layer may be advantageously formed of a photoconductive material opposite in conductivity from the material of the photoconductive layer.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
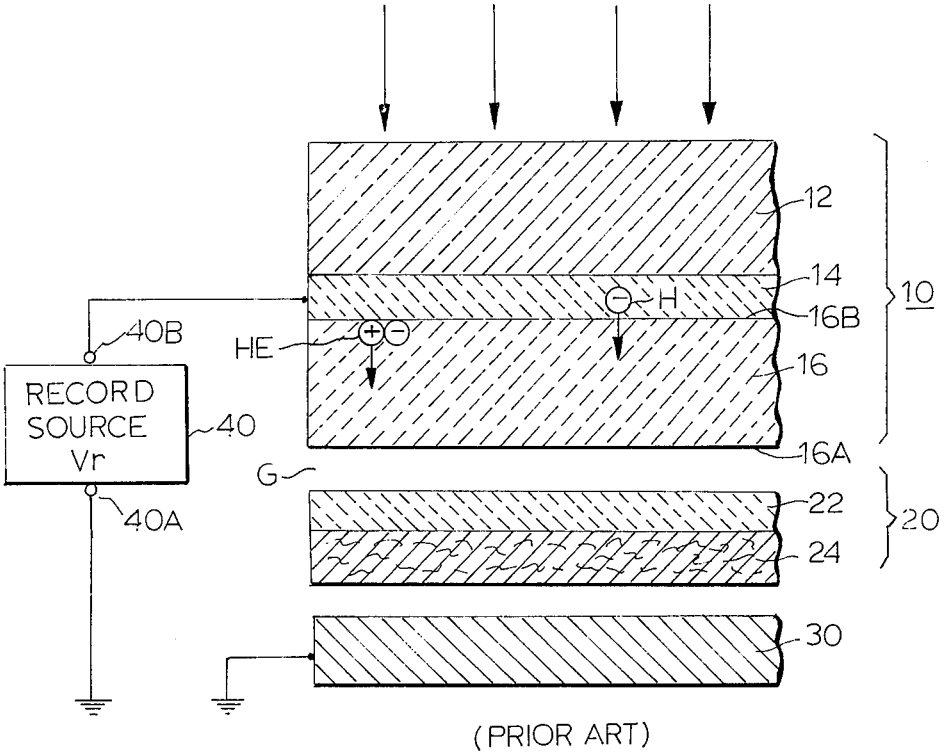
(PRIOR ART) FIG. 1
FIG. 1 is a fragmental sectional view of a conventional electrophotographic apparatus constructed in accordance with the principles of a so-called TESI and showing an electric circuit operatively connected thereto.

Referring now to the drawings and FIG. 1 in particular, there is illustrated an arrangement for carrying out a conventional electrophotographic process embodying the principles of the TESI. The arrangement illustrated comprises a photosensitive plate generally designated by the reference numeral 10, a recording medium of dielectric material generally designated by the reference numeral 20 and a metallic electrode in the form of a plate generally designated by the reference numeral 30 and disposed one above another in the named order with a very narrow gap G formed between the photosensitive plate and recording medium 10 and 20 respectively. Only for purposes of illustration the gap G is exaggeratedly shown and the recording medium 20 is shown as being spaced away from the electrode 30 although in practice the two are actually in contact with each other. The photosensitive plate 10 includes a transparent supporting substrate 12, a transparent electrode layer 14 disposed on the substrate 12 and a photoconductive layer 16 having a pair of first and second surfaces 16A and 16B disposed oppositely to each other with the electrode layer 14 disposed on one of the main faces, in this case, the second main surface 16B. Thus the photoconductive layer 10 has a three layer structure.

The recording medium 20 includes a high resistance dielectric layer 22 and a base sheet of paper 24 having a low resistance and disposed on the layer 22.

The metallic electrode 30 is connected to a point of reference potential such as ground.

The arrangement further comprises a source of recording DC voltage 40 for producing a voltage with a predetermined polarity and having a first terminal 40A connected to ground and a second terminal 40B connected to the transparent electrode layer 14 of the photosensitive plate 10. Thus the recording source 40 has the first terminal 40A electrically coupled to the recording medium 20 through the electrode 30. In the arrangement of FIG. 1 the polarity of the source 40 is such that the first and second terminals 40A and 40B respectively are at a negative and a positive potential because the photoconductive plate 10 has a P type conductivity. Therefore the majority carriers in the P type photoconductive layer 16 are holes.

In operation, an imaging light L as shown by the arrows corresponding to an object to be recorded falls upon the transparent supporting substrate 12 of the photosensitive plate 10 and passes through the substrate and transparent electrode layer 12 and 14 respectively until it irradiates the second main surface of the photoconductive layer 16.

The irradiation with the imaging light L causes the generation of hole-electron pairs HE in that portion of the photoconductive layer 16 adjacent to the second main surface 16B. It will be understood that those hole-electron pairs are generated only in the bright portion of the imaging light L or that portion of the layer actually irradiated with the light. Among the hole-electrons pairs, the holes in this case are attracted by the negative potential applied to the recording medium 20 until the holes are transferred to the first main surface 16A of the photoconductive layer 16. On the other hand, electrons are drawn out from the second main surfaces 16B by the transparent electrode layer 14. As a result, the first main surface 16A has formed thereon an electrostatic latent image corresponding in pattern to the imaging light L and, in this case, having a positive polarity.

Then the electrostatic latent image thus formed on the first main surface 16A of the photoconductive layer 16 is transferred to the high resistance layer 22 of the recording medium 20 across the very narrow gap G by the action of the negative potential applied to the recording medium 20 through the electrode 30.

Under these circumstances, undesirable carriers from the transparent electrode layer 14 injected into the photoconductive layer 16 are holes H. Those holes H are also attracted by the negative potential applied to the recording medium 20 so as to be collected on the first main surface 16A of the photoconductive layer 16 thereby to impart background noise to the electrostatic latent image formed on the same main face as above described.

Figure 2:
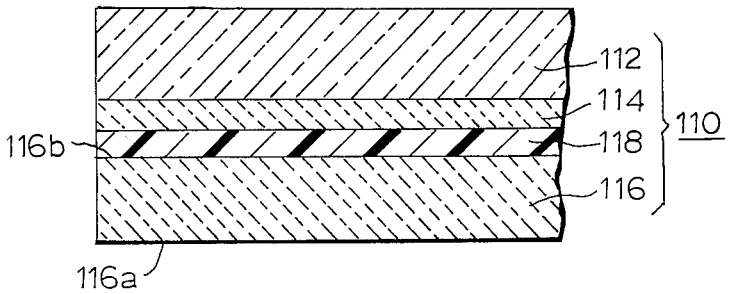
FIG. 2 is a fragmental sectional view of a photosensitive plate constructed in accordance with the principles of the present invention.

FIG. 2 shows a photosensitive plate constructed in accordance with the principles of the present invention. The photosensitive plate is generally designated by the reference numeral 110 and has a five layer structure including layers 112, 114, 118 and 116 superposed on one another in the named order. The first layer 112 is a supporting substrate for the photosensitive plate 110, and is composed of any suitable transparent material such as glass and has a thickness sufficient to provide the mechanical strength required for the photosensitive plate 110. The supporting substrate 112 may also be composed of any of transparent organic resin such as fluorine containing polymers, polycarbonate resins, polyethylene-terephthalate resins etc.

The second layer 114 is a transparent electrode layer formed of any suitable electrically conductive material having a high transparency, for example, tin oxide and thin enough to provide the electric conductivity required therefor. Suitable materials for the electrode layer 114 are, in addition to tin oxide, indium oxide, copper iodide etc. If desired, the electrode layer 114 may be formed of a translucent metallic film prepared by an evaporation technique.

The fourth layer 116 is a photoconductive layer having a predetermined type of conductivity and includes a pair of first and second main surfaces 16*a* and 116*b* opposite to each other. The first main surface 116*a* is adapted to be disposed opposite to a recording medium (not shown) such as above described in conjunction with FIG. 1 with a very narrow gap formed therebetween. The second main surface 116*b* is in contact with the third layer 118 as will be described later and is adapted to receive an optical image or an imaging light as previously described incident upon the substrate 112.

Since the photoconductive layer 116 has a predetermined type conductivity, the material thereof should be selected dependent upon the conductivity type. For example, a photoconductive layer 116 having a P type conductivity may be formed of any suitable P type photoconductive material such as selenium (Se) a selenium-tellurium (Se-Te) alloy, selenium arsenide (Se-As) or the like. On the other hand, if the photoconductive layer 116 is required to have an N type conductivity then it may be formed of any suitable N type photoconductive material such as zinc oxide (ZnO), cadmium sulfide (CdS), cadmium arsenide (CdSe), lead oxide (PbO) or the like. The photoconductive layer 116 is disposed on the third layer 118 by evaporating any one of the photoconductive materials as above described upon the layer 118. Alternatively, a selected one of those photoconductive materials may be bonded in the form of a powder to the third layer 118 by using any suitable organic resin. Also a powder of a selected one of the photoconductive materials may be sintered into a layer.

According to the principles of the present invention, the third layer 118 having special properties is an additional layer sandwiched between the second main surface 116*b* of the photoconductive layer 116 and the adjacent surface of the transparent electrode layer 114. The third layer 118 should have the following properties: Firstly the layer 118 must have the property that in the process of irradiating the second main surface 116*b* of the photoconductive layer 116 with an imaging light to form a corresponding electrostatic latent image on the first main surface 116*a* thereof, undesirable carriers from the transparent electrode layer 114 are prevented from being injected into the photoconductive layer 116. For example, for a P type photoconductive layer 116, it is required to prevent holes from the electrode layer 114 from being injected into the photoconductive layer 116. Secondly, the third layer 118 must have the property that it permits an optical image to be passed therethrough and transmitted to the photoconductive layer 116 with a high efficiency.

It has been found that the additional layer 118 can be formed of polyvinyl carbazole (P.V.K) with satisfactory results. The polyvinyl carbazole presents a very high electric resistance to visible light used in forming an optical image by irradiating the photoconductive layer 116 and practically serves as an electrically insulating layer. Thus upon irradiating the photoconductive layer 116 with an imaging light through the transparent substrate and electrode layer 112 and 114 respectively and the additional layer 118, the latter practically behaves as an electrically insulating layer sufficient to prevent undesirable carriers from the transparent electrode layer 114 from being injected into the photoconductive layer 116. Thus the additional layer may be called a carrier blocking layer. Also the polyvinyl carbazole has a good transmittivity with respect to visible light. Therefore the additional layer 118 formed of polyvinyl carbazole meets the requirement of satisfactorily the two properties as above described and can be operatively associated with both the P and N types of photoconductive layers.

The thickness of the transparent carrier blocking layer 118 is required to have a magnitude sufficient to prevent the undesirable carriers from the transparent electrode layer 114 from being injected into the photoconductive layer 116 due to the tunnel effect of the layer 118. For this purpose the thickness of the third layer 118 should be 0.03 microns or more. Although the blocking layer 118 has no upper limit to the thickness particularly definitely determined, an excessive thickness thereof will cause an attenuation of the optical image in the blocking layer 118 that cannot be disregarded. Therefore it has been found that the upper limit of the thickness is 50 microns and that the thickness preferably ranges from 1 to 20 microns.

Figure 3A:
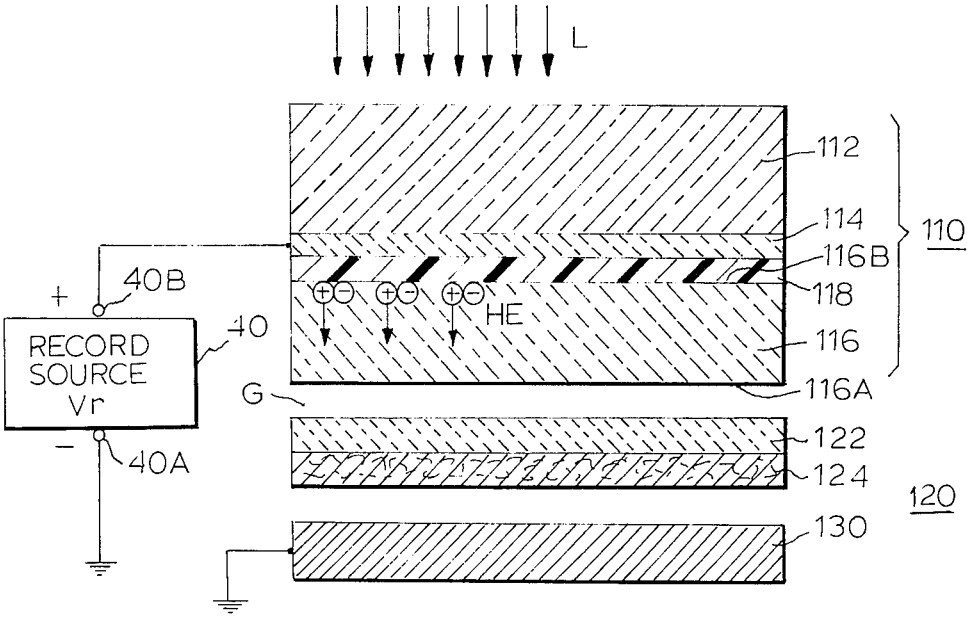
FIGS. 3*a* and 3*b* are sectional views illustrating a recording step of an electrophotographic process using a photosensitive plate according to the present invention.

The recording step of the electrophotographic process employing the photosensitive plate of FIG. 2 in accordance with the principles of the present invention will now be described with reference to FIGS. 3*a* and 3*b* wherein like reference numerals designate the components identical or similar to those shown in FIGS. 1 and 2. From FIG. 3*a* wherein there is illustrated the step of forming an electrostatic latent image on a recording medium by irradiation with a corresponding optical image, it is seen that the arrangement disclosed comprises the photosensitive plate 110, a dielectric recording medium 120 and an electrode 130 disposed in a similar manner as above described in conjunction with FIG. 1. As in the arrangement of FIG. 1, the recording medium 120 includes a dielectric layer 122 having a high electric resistance and a base sheet of paper 124 having a low electric resistance and superposed on the layer 122. The dielectric layer 122 is disposed opposite to the photoconductor layer 116 with a very narrow gap G formed therebetween while the base sheet of paper 124 is disposed upon the electrode 130 similar to the electrode 30 as shown in FIG. 1 although the base sheet 124 is shown in FIG. 3*a* as being somewhat spaced away from the electrode 130. This is because the two components 120 and 130 are shown as being separate members. Also the gap G is shown in a exaggerated size in FIG. 3*a* only for purposes of illustration.

The arrangement further comprises a source of recording voltage 140 including a first terminal 140A connected to a point of reference potential, for example, ground so as to be electrically coupled to the dielectric layer 122 of the recording medium 120 through the grounded electrode 130 and a second terminal 140B connected to the transparent electrode layer 114 of the photosensitive plate 110. The recording source 140 produces a recording voltage Vr with a predetermined polarity for example, a DC voltage of from 400 to 500 volts having a predetermined polarity. The first and second terminals 40A and 40B of the source 40 is shown in FIG. 3*a* as being at a negative and a positive potential respectively because the photoconductive layer 116 has been assumed to have a P type conductivity. The source 40 may be an electric source for producing either a DC voltage by the half- or full-wave rectification of an AC voltage or a voltage with a predetermined polarity having a rectangular or triangular waveform.

In operation an imaging light L as shown by the arrows in FIG. 3*a* is incident upon the transparent substrate 112 and then irradiates the photoconductive layer 116 through the transparent electrode layer and carrier blocking layer 114 and 118 respectively. The imaging light L results from an object to be recorded being irradiated by a light source for example on incandescent tungsten lamp a xenon discharge lamp, an iodine discharge lamp, a semiconductor luminescent diode, a laser or the like. Generally the imaging light is visible light although a cathode ray tube may sometimes be utilized. Only for purposes of illustration it is assumed that the imaging light includes a bright portion on the lefthand part as viewed in FIG. 3*a* and a dark portion on the righthand part. The bright portion of the imaging light L actually irradiates that portion of the substrate 112 located directly below the same while the dark portion thereof does not irradiate that portion of the substrate 112 directly located below the same.

Under the assumed condition, hole-electron pairs HE are generated in that portion of the photoconductive layer 116 irradiated with the bright portion of the imaging light L and particularly adjacent to the main surface 116B thereof. As in the arrangement of FIG. 1, holes of the hole-electron pairs HE are transferred to the opposite main surface 116A of the photoconductive layer 116 to form a corresponding electrostatic latent image with a positive polarity. Under these circumstances, the carrier blocking layer 118 practically acts as an electrically insulating layer as above described so that undesirable carriers, in this case, holes from the electrode layer 114, are prevented from being injected into the photoconductive layer 116. Also electrons of the hole-electrons pairs HE tend to be introduced into the electrode layer 114 but such electrons are blocked by the high resistance layer 118. As a result, an electric charge is accumulated on either side of the carrier blocking layer 118.

The positive electrostatic latent image appearing on the first main surface 116A of the photoconductive layer 116 is then transferred to the dielectric layer 122 of the recording medium 120 through the very narrow gap G formed therebetween. The mechanism by which the electrostatic latent image on the first main photoconductive surface 116A is transferred to the recording medium through the minute gap G is not yet definitely understood and it may be explained as resulting from an electric discharge occurring across the very narrow gap or the field ionization occurring through a potential barrier in the very narrow gap. However the present invention should not be restricted by either of the image transfer actions as above described.

Figure 3B:
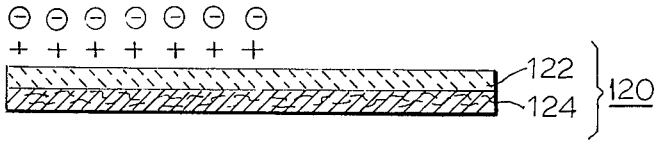

The recording medium 120 bearing the positive electrostatic latent image on the dielectric layer 122 advances to a development step as illustrated in FIG. 3*b*. In the development step, a toner powder negatively charged is sprinkled over the dielectric layer 122 to convert the electrostatic latent image to a corresponding toner image. Then the toner image is heated so as to be fixed on the layer 122 resulting in a visible recorded image corresponding to the imaging light L. If desired, the electrostatic latent image on the recording medium 120 may be developed in any suitable known manner other than by toner development.

Figure 4A:
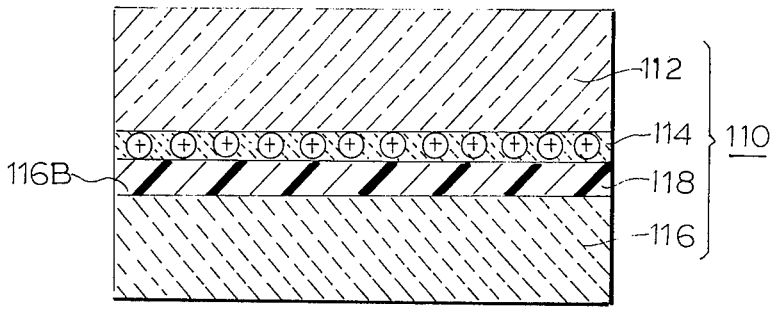
FIG. 4*a* is a sectional view of the arrangement shown in FIG. 2 after having been subject to the recording step shown in FIG. 3.

After the completion of the recording step the photosensitive plate 110 has the accumulated charge left on either side of the blocking layer 118 as shown in FIG. 4*a* wherein like reference numerals designate the components identical to those shown in FIG. 3*a*. This charge should be erased provided that the photosensitive plate 110 is desired to be employed in the next succeeding electrophotographic process. Polyvinyl carbazole forming the carrier blocking layer 118 has another significant property relating to the erasure of an accumulated charge on the layer 118. That is, polyvinyl charbazole becomes photoconductive to light in the ultraviolet region. Thus by utilizing this, it is possible to erase the accumulated charge on the carrier blocking layer 118.

Figure 4B:
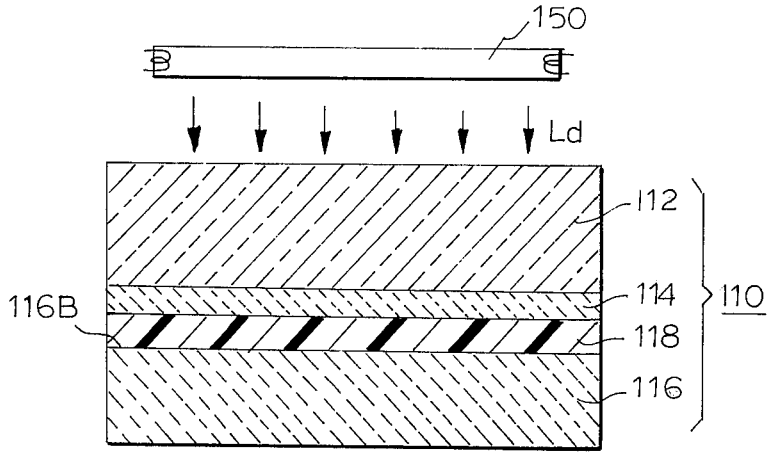
FIG. 4*b* is a sectional view illustrating an erasing step in the electrophotographic process using a photosensitive plate according to the present invention.

FIG. 4*b* wherein like reference numerals designate the components identical to those shown in FIG. 4*a* illustrates the step of erasing the electric charge just described. In FIG. 4*b* a source of ultraviolet light is shown as comprising a mercury discharge lamp 150. Ultraviolet light $L_D$ from the mercury discharge lamp 150 irradiates the entire surface of the blocking layer 118 through the transparent substrate and electrode layer 112 and 114 respectively with a uniform light intensity. The ultraviolet light $L_D$ serves as an erasing light so that the blocking layer 118 irradiated with that light becomes electrically conductive to permit the discharge of the accumulated charge on either side thereof. This results in the erasure of the accumulated charge.

Figure 4C:
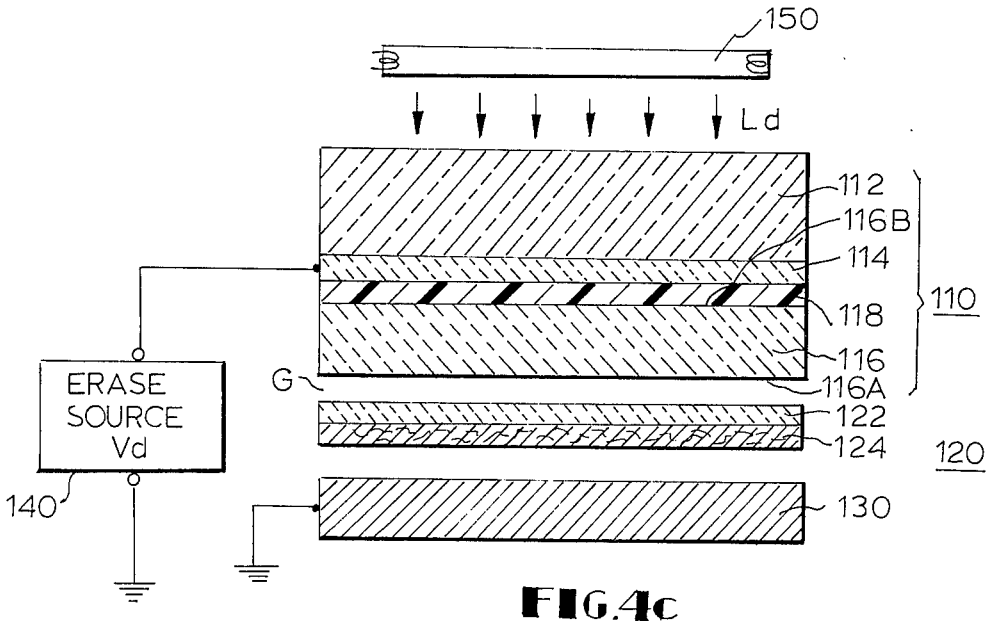
FIG. 4*c* is a view similar to FIG. 4*b* but illustrating another erasing step using the plate of the present invention.

The electric charge accumulated on either side of the third layer 118 can be erased by an arrangement as shown in FIG. 4*c* wherein like reference numerals designate the components identical to those shown in FIG. 3*a*. The arrangement of FIG. 4*c* is substantially similar to that shown in FIG. 3*a* excepting that a mercury discharge lamp 150 is disposed above the photosensitive plate 110 as in the arrangement of FIG. 4*a* and that a source of erasing DC voltage 140 is connected across the transparent electrode layer 114 of the photosensitive plate 110 and the electrode 130 with the polarity reversed from that in the recording step. More specifically, the source 140 has a negative terminal connected to the transparent electrode layer 114 and a positive terminal connected to the electrode 130 to apply an erasing DC voltage Vd across the layer and electrode 114 and 130 respectively.

In FIG. 4*c* ultraviolet light Ld from the mercury discharge lamp 150 irradiates the photosensitive plate 110 with a new record medium 120 disposed on the electrode 130 to provide for the next recording process. This irradiation with the ultraviolet light Ld is effective for erasing the accumulated charge on either side of the additional layer 118 as above described in conjunction with FIG. 4*a* and also for drawing minority carriers, in this case, electrons within the photoconductive layer 116 toward the main surface 116A thereof. This drawing of the electrons permits the negative charge to be uniformly formed on the first main surface 116A of the photoconductive layer 116 resulting in an increase in contrast of an electrostatic latent image with the positive polarity formed on the main photoconductive surface 116A through the irradiation with the next succeeding imaging light.

The carrier blocking layer 118 may be formed of any photoconductive material other than polyvinyl carbazole and having an opposite polarity from the material of the photoconductive layer 116. For a P type photoconductive layer 116 the blocking layer 118 is formed of an N type photoconductive material selected from the group consisting of inorganic photoconductive materials such as zincsulfide (ZnS), zinc oxide (ZnO) etc. and organic photoconductive materials such as anthracene.

With a P type photoconductive layer 116 operatively associated with an N type blocking layer 118, the photosensitive plate 110 is irradiated with an imaging light L while the transparent electrode layer 114 and the record medium 120 are put at a positive and a negative potential respectively. Under these circumstances, it will be understood that the interface between the layers 116 and 118 forming a P-N junction is reversely biased with the applied voltage. This reverse bias of the interface between the layers 114 and 116 is effective for preventing undesirable holes from the electrode layer 114 from being injected into the photoconductive layer 116 during the irradiation with an optical image. Also the blocking layer 118 can more or less attenuate an imaging light incident upon the photoconductive layer 116. If the blocking layer 118 is as thin as an the order of from 1 to 5 microns then the photoconductive layer 116 can be irradiated with the imaging light still having a satisfactory intensity.

On the other hand, for an N type photoconductive layer 116, the carrier blocking layer 118 can be any P type photoconductive material selected from the group consisting of selen (Se), cadmium telluride (CdTe) etc. Since the P type photoconductive materials just described are electrically conductive when irradiated with visible light, an electric charge accumulated on either side of the transparent blocking layer 118 in the recording step can be erased by irradiation with visible light.

Figure 5:
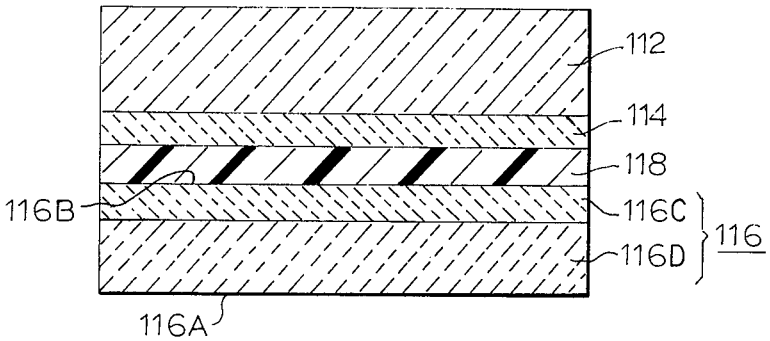
FIG. 5 is a fragmental sectional view of a modification of the arrangement shown in FIG. 2.

In the photosensitive plate 110 as shown in FIG. 2 the hole-electron pairs are generated on that portion of the photoconductive layer 116 adjacent to the second main surface 116B while the remaining portion of the photoconductive layer 116 is not necessarily suitable for transferring the carriers therethrough. This objection can be eliminated by a photosensitive plate as shown in FIG. 5 wherein like reference numerals designate components identical to those shown in FIG. 2. The arrangement is different from that shown in FIG. 2 only in that in FIG. 5 the photoconductive layer has a composite structure.

More specifically, the photoconductive layer 116 includes a carrier generation sub-layer 116C and a carrier transfer sub-layer 116D interconnected. The generation sub-layer 116C is located on the side of the second main surface 116B of the photoconductive layer 116 and is formed of any suitable photoconductive material having a high absorption coefficient with respect to an optical image incident thereon and is responsive to the optical image to generate hole-electron pairs with a high efficiency. The transfer sub-layer 116C may be of the same photoconductive material as the photoconductive layer 116 as shown in FIG. 2. The transfer sub-layer 116D is located on the side of the first main surface 116A of the photoconductive layer 116 and is formed of any suitable photoconductive material through which the desired carriers of the hole-electron pairs generated in the sub-layer 116C are efficiently transferred to the first main surface 116A. The sublayer 116D may be formed of polyvinyl carbazole.

While the present invention has been illustrated and described in conjunction with a few preferred embodiments thereof it is to be understood that numerous changes and modifications may be resorted to without departing from the spirit and scope of the present invention.

What we claim is:

1. An electrophotographic apparatus comprising: a photoconductive layer of a predetermined conductivity type having a pair of first and second main surfaces opposite to each other and including majority carriers having a predetermined polarity for receiving an imaging light to be recorded to generate hole-electron pairs in that portion of said layer adjacent to said second main surface, a transparent electrode layer disposed on the side of the second main surface of the photoconductive layer, a dielectric recording medium disposed in spaced opposed relationship with the first main surface of the photoconductive layer with a gap therebetween, a source of DC recording voltage coupled across said transparent electrode layer and said dielectric recording medium for applying a DC recording voltage with a polarity making said transparent electrode layer identical in polarity to the majority carriers present in said photoconductive layer, said DC recording voltage being for transferring those carriers of said hole-electron pairs identical in polarity to said majority carriers present in said photoconductive layer to said first main surface of said photoconductive layer thereby to form an electrostatic latent image corresponding to said imaging light on said first main surface of said photoconductive layer and also to transfer said electrostatic latent image to said dielectric recording medium, and a carrier transparent blocking layer sandwiched between said second main surface of said photoconductive layer and said transparent electrode layer, said carrier blocking layer being for permitting said imaging light to pass to the second main surface of the photoconductive layer and also to prevent those carriers identical in polarity to said majority carriers present in said photoconductive layer from being injected into said photoconductive layer from said transparent electrode layer.

2. An electrophotographic apparatus as claimed in claim 1 wherein said transparent carrier blocking layer is polyvinyl carbazole.

3. An electrophotographic apparatus as claimed in claim 1 wherein said transparent carrier blocking layer is a photoconductive material having the opposite polarity from the material of said photoconductive layer.

4. An electrophotographic apparatus as claimed in claim 1 wherein said transparent carrier blocking layer is an N type photoconductive material and said photoconductive layer is a P type conductivity material.

5. An electrophotographic apparatus as claimed in claim 1 wherein said transparent carrier blocking layer is a P type photoconductive material and said photoconductive layer is an N type conductivity material.

6. An electrophotographic apparatus as claimed in claim 1 wherein said carrier blocking layer is a photoconductive material, whereby a charge erasing step can be conducted in which, after the completion of said recording step, said transparent carrier blocking layer is irradiated with light through said transparent electrode layer to make the carrier blocking layer electrically conductive for erasing the electric charge which has accumulated on either side of said carrier blocking layer during the recording step.

7. An electrophotographic apparatus as claimed in claim 1 in which said transparent carrier blocking layer has a thickness of from 0.03 to 50 microns.

8. An electrophotographic apparatus as claimed in claim 1 in which said transparent carrier blocking layer has a thickness of from 1 to 20 microns.

* * * * *